US005680779A

United States Patent [19]

Na

[11] Patent Number: 5,680,779

[45] Date of Patent: Oct. 28, 1997

[54] WASHER WITH A WASH PLATE

[75] Inventor: Jae-Hyun Na, Kwang-Ju, Rep. of Korea

[73] Assignee: Daewoo Electronics Co., Ltd., Seoul, Rep. of Korea

[21] Appl. No.: 596,441

[22] Filed: Feb. 2, 1996

[30] Foreign Application Priority Data

Jun. 26, 1995 [KR] Rep. of Korea ..... 95-17380

[51] Int. Cl.[6] ..... D06F 17/08; D06F 17/10

[52] U.S. Cl. ..... 68/133; 68/134

[58] Field of Search ..... 68/131, 133, 134, 68/53

[56] References Cited

U.S. PATENT DOCUMENTS

| | | | |
|---|---|---|---|
| 3,071,955 | 1/1963 | Platt et al. | 68/53 |
| 4,520,638 | 6/1985 | Brenner | 68/133 |
| 5,487,284 | 1/1996 | Kim et al. | 68/133 X |

FOREIGN PATENT DOCUMENTS

| | | | |
|---|---|---|---|
| 146575 | 6/1989 | Japan | 68/134 |

*Primary Examiner*—Philip R. Coe

*Attorney, Agent, or Firm*—Beveride, DeGrandi, Weilacher & Young LLP

[57] ABSTRACT

Described is a washer having a driving unit which is installed at the lower portion of a rotation axis and rotates the rotation axis, a feed unit which is axially connected to the rotation axis and moves up and down as the rotation axis rotates, and a wash plate which is fixedly installed at the upper portion of the feed unit and has an up-and-down motion as the rotation axis rotates. An up-and-down motion of the wash plate enables even distribution of a heart-type water flow, which then contributes to the prevention of tangling of wash articles at the central portion of a wash tub as well as clinging of wash articles to a pulsator. By using a washer of the present invention, increased washing efficiency can be expected.

6 Claims, 3 Drawing Sheets

WASHER WITH A WASH PLATE

BACKGROUND OF THE INVENTION

1. Field of the Invention

This invention is related to a washer, particularly to a washer equipped with a wash plate to increase efficiency of washing through an up-and-down alternating motion of the washer.

2. Description of the Prior Art

Generally, a home appliance washer is an apparatus to wash and remove soil attached to the surface of laundry using wash water, a detergent, etc. Recently, many types of washers have been designed and manufactured.

One type of a washer is shown in FIG. 1. At the lower portion of the outer side of a wash tub, an electric motor 10 is installed, and a power transmission 11 transmitting rotation power is connected to the electric motor 10. The power transmission 11 includes a first gear 11*a* rotating by the rotation power of the electric motor 10, a belt 11*b* transmitting the rotation power of a first gear 11*a*, and a second gear 11*c* rotating by the belt 11*b*. The rotation shaft 21 driven by a power transmission 11 is axially connected to the central part of the second gear 11*c*, and is then projected to the inner lower portion of the wash tub. In other words, the rotation power generated by the electric motor 10 as power is supplied is transmitted to the rotation shaft 21 through a power transmission 11.

The lower end of the rotation shaft 21 is axially connected to the central portion of the second gear 11*c*, while the upper end of the rotation axis 21 is fixedly installed by a pulsator 22 by a set member 22*a*. The upper surface of the pulsator 22 has several vane projections, between which a plurality of water transit holes 22*c* are provided to enable flow of water.

As the rotation shaft 21 rotates, the pulsator 22 is rotated, as well as wash water subsequently. According to cyclic rotary motion of the motor 10, the pulsator 22 rotates, which then leads to rotation of wash water and wash articles. Wash articles are then rubbed against vane projections 22*b* of the pulsator 22, after which soil from the articles is removed.

In a conventional home washer, centrifugal force is generated by the rotation of the pulsator 22, and this centrifugal force affects wash water in some ways. That is, because of the centrifugal force generated, water flow at the outer portion of the wash tub is elevated, while that at the central portion is lowered. Accordingly, the water flow formed would be a heart-type water flow. At this time, if wash articles are loaded at the central portion of the wash tub, they may tangle, and thus efficiency of washing is lowered. Further, articles may cling to the surface of the pulsator 22, which causes the damage to their quality.

SUMMARY OF THE INVENTION

Therefore, an object of the present invention is to provide a washer having increased washing efficiency by producing a vertical-type water flow from a heart-type water flow which is induced by the rotary motion of the pulsator.

It is another object to provide a washer having a wash plate with a plurality of water transit holes to increase washing efficiency by rubbing wash articles with wash water introduced through water transit holes.

These and other objects may be achieved with a washer constructed according to the principles of the present invention which is comprised of a moving unit, a driving unit, and a wash plate. The moving unit is screwed lyby assembled with the rotation shaft and moves up and down as the rotation shaft rotates; the driving unit is installed at the lower portion of the rotation shaft to rotate the rotation shaft; and the wash plate is fixedly attached to the upper portion of the moving unit and moves up and down as the rotation shaft rotates due to an action of the moving unit.

In one preferred embodiment of the present invention, as power is supplied, the rotation shaft rotates by the rotation power of the motor, and the wash plate moves up and down by an action of the moving unit, thus preventing tangling of the wash articles circulating at the central portion of the wash tub due to an up-and-down motion of the wash plate. This way, an increased efficiency in washing can be expected.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF THE PREFERRED EMBODIMENTS

Figure 1:
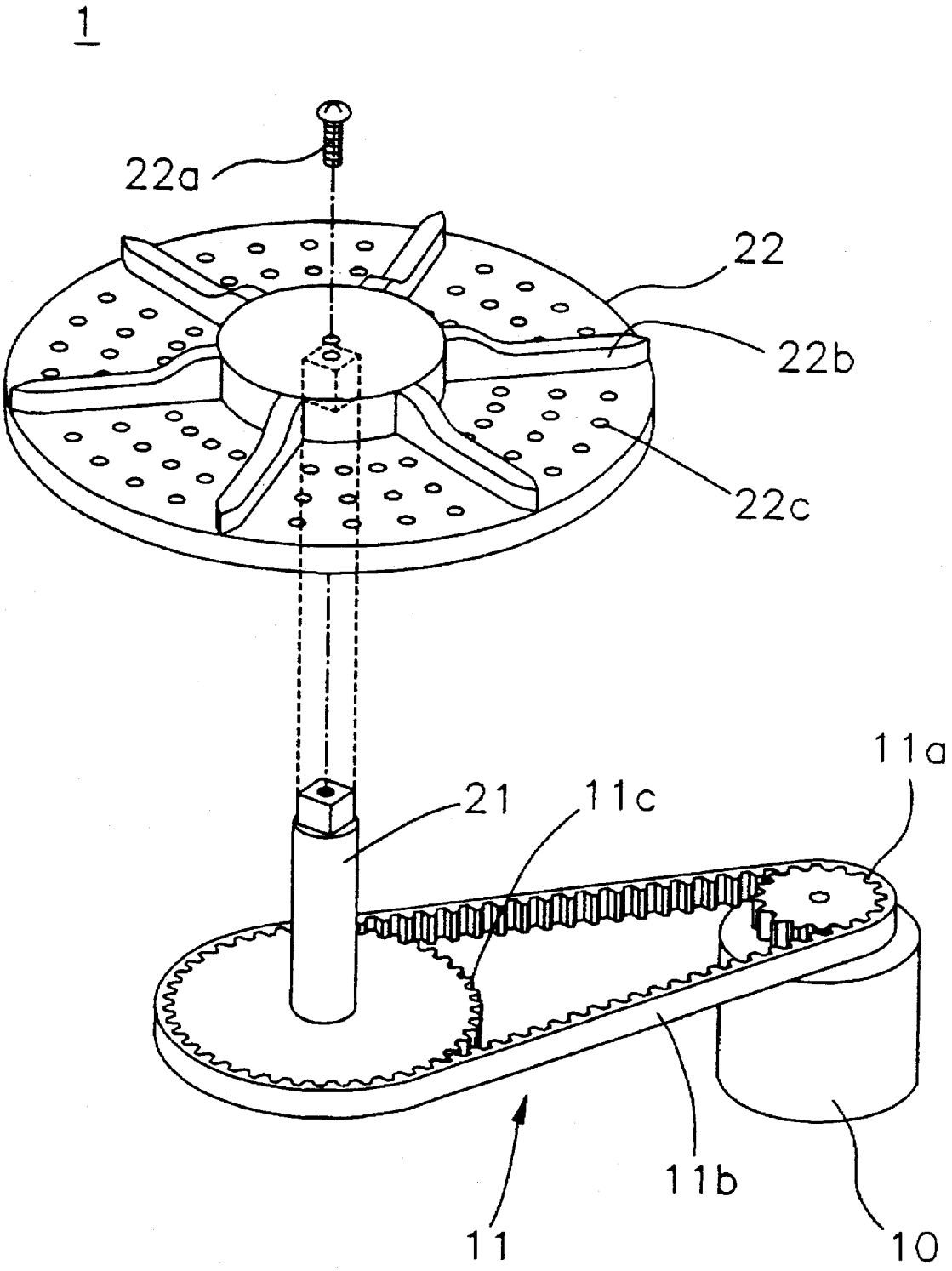
FIG. 1 PRIOR ART
FIG. 1 is a partial exploded perspective view of a conventional washer.
Figure 2:
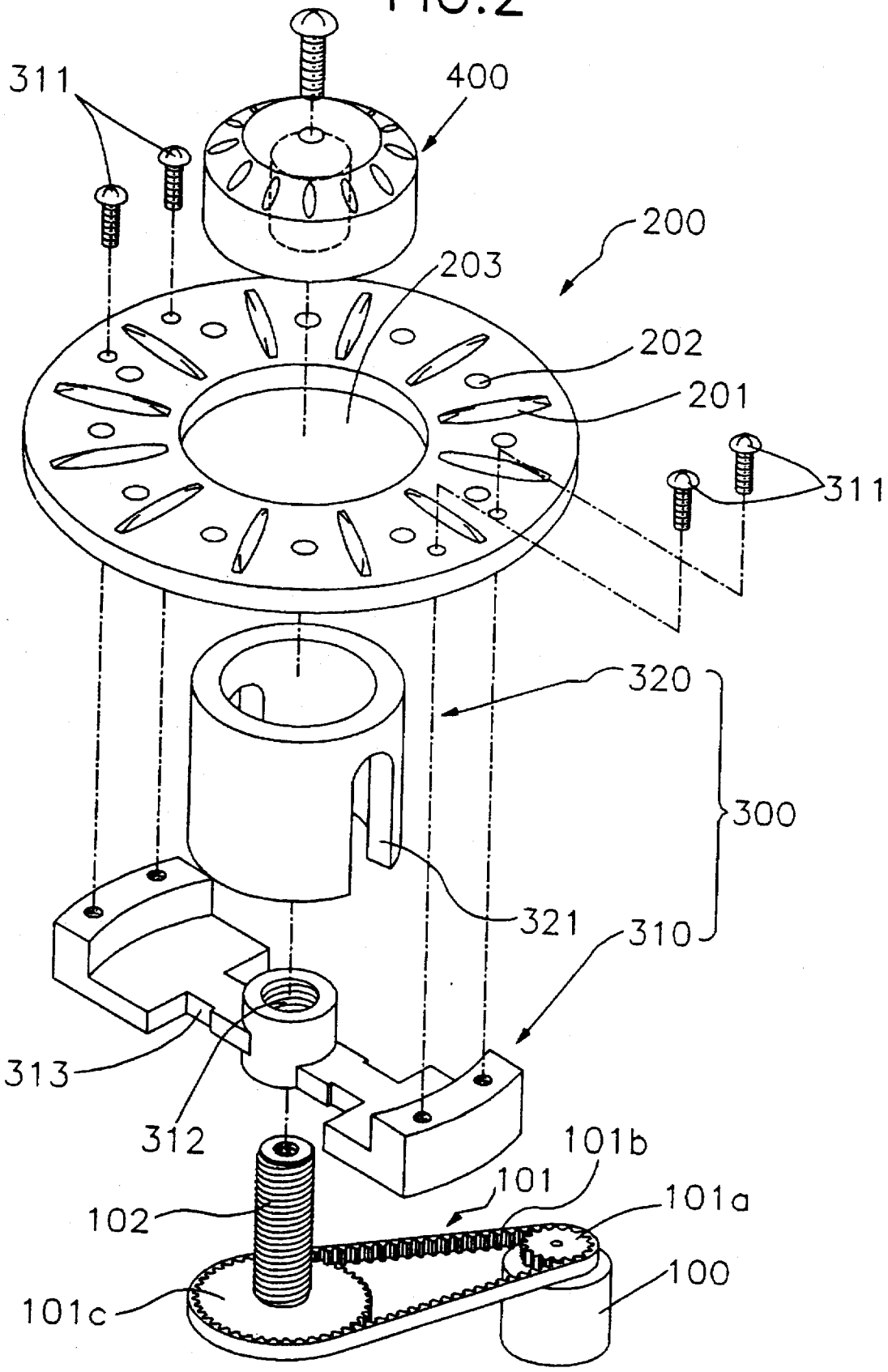
FIG. 2 is a partial exploded perspective view of a washer embodying the principles of the present invention.

FIG. 2 is a partial exploded perspective view of a washer of the present invention. As shown in FIG. 2, the washer is operated by a motor 100 which is driven by an inputted supply of AC power from exterior. To this motor 100, a power transmission 101, which is comprised of a first gear 101*a*, a second gear 101*c*, and a belt 101*b* in a usual way, is fixedly installed. To the central part of the second gear 101*c*, a rotation shaft 102 in the form of a male screw, is axially connected. The rotation power generated by a rotary motion of the motor 100 is transmitted to the rotation shaft 102 through the power transmission 101.

A wash plate 200, which moves up and down by the rotation power of a rotation shaft 102, has a shape of a round plate, of which surface is provided with a plurality of vane projections 201 in a radial fashion. The vane projections 201 shown in this embodiment have a form of a rod, however, the shape of the vane projections can be modified to have a conical form, a mixed form, etc. Between the projections 201 of the wash plate 200 are provided with a plurality of water transit holes 202 which allow water flow between the upper and lower portions of the wash plate 200. An up-and-down motion of the wash plate 200 induces pressure to the wash water in the upper space or the lower space, which is then diminished by the wash water flowing through the water transit holes 202. The wash water flowed from the water transit holes 202 is then contacted with wash articles to be washed.

In the meantime, a penetration hole 203 having a predetermined diameter is formed at the central part of the wash plate 200. The lower portion of the wash plate 200 is fixedly contacted with a moving unit 300 which enables an up-and-down motion of the wash plate 200.

The moving unit 300 is comprised of a plate support member 310 which supports the wash plate 200 and a plate guide pipe 320 which guides the plate support member 310. In more detail, the plate support member 310 has a shape of a symmetrical plate and is fixed to the lower surface of the wash plate 200 by fixing members 311 such as screws. The inner surface of the central pipe 312 of the plate support member 310 is in the form of a female screw, which is then matched with a male screw of the rotation shaft 102. In this embodiment, the inner surface of the central pipe 312 of the plate support member 310 is in the form of a double-line screw so that the range of movement of the rotation shaft 102 per rotation is large; however, it is suggested that the form of the screw can vary. Further from the central pipe 312 of the plate support member 310, two guides 313 having depressed edges are formed symmetrically at a predetermined distance.

To the above guides 313, a plate guide pipe 320 of the moving unit 300 to allow an up-and-down motion of the plate support member 310 is connected. The plate guide pipe 320 is in a shape of an open cylinder, and has two vertical guide grooves 321 at its both sides, which are then assembled with the guides 313. It is this assembly of the guide grooves 321 with the guides 313 to enable an up-and-down motion of the plate support member 310, not a rotational motion. The range of motion of the plate support member 310 is limited to the length of the guide grooves 321.

The rotation shaft 102 passes through the central pipe 312 of the plate support member 310, the plate guide pipe 320, and the penetration hole 203 of the wash plate 100, and to the upper end of which is connected a pulsator 400.

Figure 3:
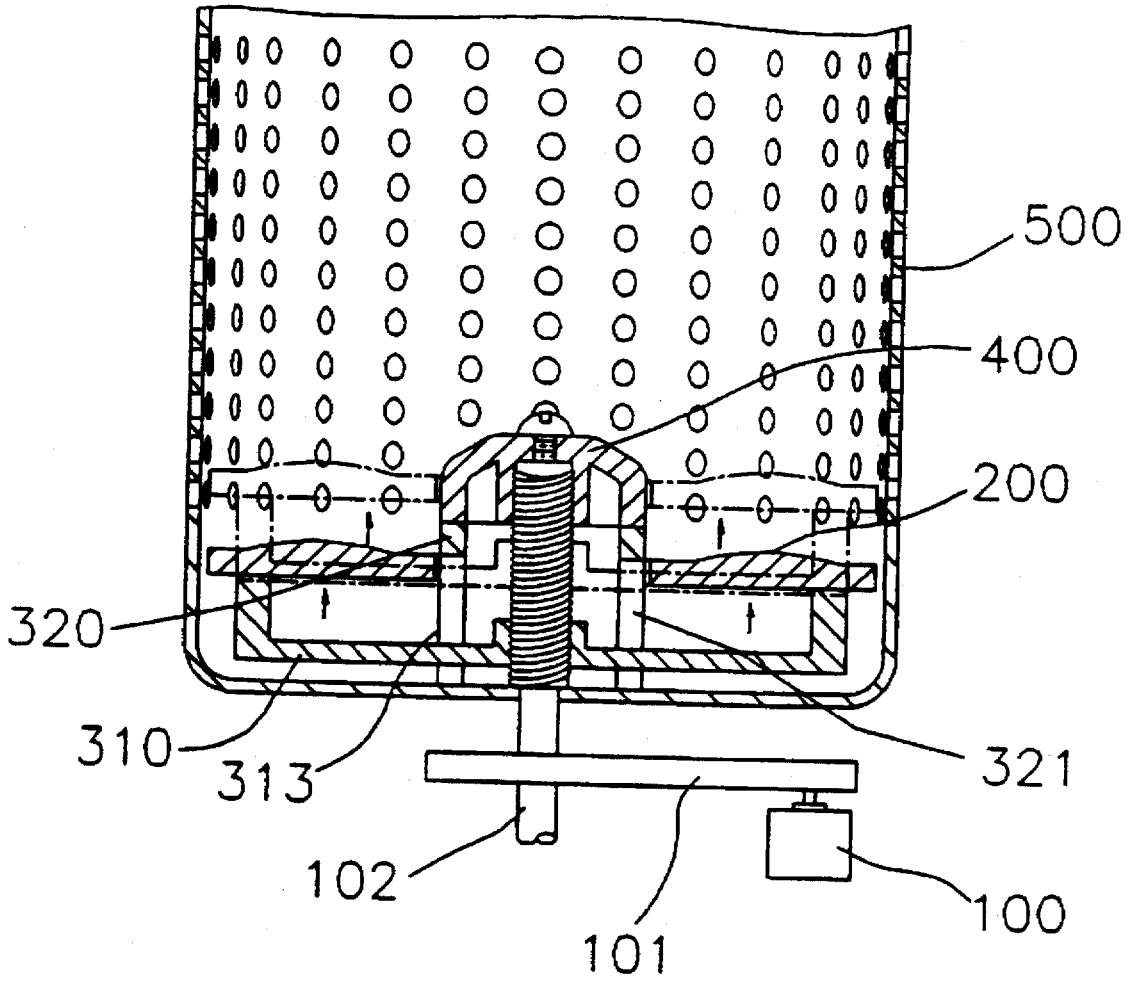
FIG. 3 is a cross-sectional view of a washer of the present invention showing how each component is assembled.

FIG. 3 shows how each component of the washer is connected. A motor 100, which is operated as power is supplied, is installed at the lower portion of the outer wash tub 500, and to the motor 100, a power transmission 101 is fixedly attached. To the central part of the power transmission 101, a rotation shaft 102 is axially connected, which is then projected to the inner lower portion the wash tub 500.

The rotation shaft 102 passes through a penetration hole 203 of the plate support member 310, after which a plate guide pipe 320 covers the plate support part 310 so that guide grooves 321 and guides 313 are combined. The rotation shaft 102 then passes through the central portion of the plate guide pipe 320, and to the upper end of the rotation shaft 102 a pulsator 400 is fixedly installed.

In a washer combined as described above, the motor 100 rotates as power is supplied from exterior, and the rotation power generated by the rotation of the motor 100 is transmitted to the rotation shaft 102, which is projected into the lower portion of the wash tub 500, through a power transmission 101.

The rotation of the rotation axis 102 then induces the rotation of a pulsator 400, and further the rotation of wash water, thus creating a heart-type water flow. At this time, the plate support member 310 may tend to rotate because of the rotation of the rotation shaft 102; however, as the guides 313 of the plate support member 310 are combined with the guide grooves 321 of the plate guide pipe 320, the plate support member 310 has an up-and-down motion, not a left-and-right side motion.

Further, as the plate support member 310 is fixedly attached to the wash plate 200, the up-and-down motion of the plate support member 310 leads to the up-and-down motion of the wash plate 200, thus creating a vertical-type water flow. In other words, the water flow in the wash tub 500 is a mixed type of a heart-type water flow and a vertical-type water flow, wherein the heart-type water flow is due to the rotation of the pulsator 400 while the vertical-type water flow is due to an up-and-down motion of the wash plate 200. This mixed type of water flow contributes to the prevention of tangling of wash articles which may occur at the central portion of the wash tub 500 otherwise. And therefore, increase in washing efficiency to which the present invention is directed can be achieved eventually by the effect of mixed-type water flow as well as the vane projections 201 provided for the wash plate 200.

In the meantime, due to a large surface area of the wash plate 200, an up-and-down motion of the wash plate 200 creates pressure on wash water in the upper and lower spaces of the wash plate 200 in a direction of movement of wash water, after which the pressure is diminished by the wash water flowing through water transit holes 202 of the wash plate 200. That is, when the wash plate 200 moves upwards, pressure is applied to the wash water in the upper space of the wash tub 500, which results in a downward movement of the wash water through water transit holes 202. Whereas, when the wash plate 200 moves downwards, pressure is applied to the wash water in the lower space of the wash tub 500, which results in an upward movement of the wash water through water transit holes 202. At this time, the force of wash water flowing through the water transit holes 202 is equivalent to the pressure applied to the wash water while the wash plate moves up or down. The wash water passed through the water transit holes 202 comes into contact with wash articles thus enabling removal of soil attached to the surface of wash articles.

By using a washer of the present invention, it can be expected to prevent tangling of wash articles as well as their clinging to the pulsator since a heart-type water flow is evenly distributed due to a rotation motion of the pulsator 400 as well as an up-and-down motion of the wash plate 200. Further, contact of the wash water flowing through water transit holes 202 with wash articles during an up-and-down motion of the wash plate 200 can increase washing efficiency accordingly.

While the invention has been described in terms of a single preferred embodiment, those skilled in the art will recognize that the invention can be practiced with modification within the spirit and scope of the appended claims. For example, the shape of the projections of the wash plate can vary to be a stick form, a conical form, or any other mixed form; the inner surface of the central pipe of the plate support part can have a double-line screw form or a multiple-line screw form.

What is claimed is:

1. A washer for laundering wash articles, comprising:

a moving unit having a plate support member which is screwedly assembled with a rotation shaft, and a plate guide member which is formed with guide grooves in a vertical direction for accommodating and guiding parts of said plate support member respectively whereby said plate support member moves along a longitudinal direction of said rotation shaft as said rotation shaft rotates;

a driving unit for rotating said rotation shaft; and a wash plate which is fixedly attached to said plate support member in order to have an up-and-down motion as said plate support member moves up-and-down.

2. A washer as defined in claim 1, wherein said wash plate has a plurality of projections on a surface thereof, and has a penetration hole at a central part thereof through which said rotation shaft and said plate guide member pass.

3. A washer as defined in claim 2, wherein said wash plate further has a plurality of water transit holes which are provided between said projections of said wash plate and through which wash water passes in a direction opposite to a direction of movement of said wash plate to diminish pressure applied to the wash water in the direction of movement of said wash plate.

4. A washer as defined in claim 2, wherein said projections have a rod shape.

5. A washer as defined in claim 1, wherein said plate guide member has an open cylindrical form through which said rotation shaft passes, and said guide grooves are formed at a periphery of said guide member oppositely with each other.

6. A washer having a tub for accommodating washing articles, a pulsator rotatably installed in said tub, and a motor for rotating said pulsator, said washer comprising:

a wash plate which is installed movably along a vertical direction in said tub;

a plate support member which is screwedly assembled with said rotation shaft and to which said wash plate is fixedly attached in order to have an up-and-down motion as said plate support member moves up-and-down; and a plate guide member which is formed with guide grooves in a vertical direction for accommodating and guiding parts of said support member respectively whereby said plate support member moves along a longitudinal direction of said rotation shaft as said shaft rotates, wherein said wash plate is formed with a plurality of projections on a surface thereof and a plurality of water transit holes between said projections through which wash water passes in a direction opposite to a direction of movement of said wash plate to diminish pressure applied to the wash water in the direction of movement of said wash plate.

* * * * *